US005790681A

United States Patent [19]

Leppälahti

[11] Patent Number: 5,790,681

[45] Date of Patent: Aug. 4, 1998

[54] FIXING ASSEMBLY FOR A HELMET HEADSET

[75] Inventor: Kai Leppälahti, Kauniainen, Finland

[73] Assignee: Kitek Oy Ab Insinooritoimisto, Espoo, Finland

[21] Appl. No.: 791,899

[22] Filed: Jan. 31, 1997

[30] Foreign Application Priority Data

Jun. 28, 1996 [FI] Finland ..... 962673

[51] Int. Cl.[6] ..... H04R 25/00

[52] U.S. Cl. ..... 381/187; 381/183; 2/906

[58] Field of Search ..... 381/25, 183, 187, 381/168, 169; 379/430; 455/89, 90, 347, 350, 351; 2/209, 906

[56] References Cited

U.S. PATENT DOCUMENTS

| | | | |
|---|---|---|---|
| 3,786,519 | 1/1974 | Aileo | 381/187 |
| 4,875,233 | 10/1989 | Derhaag et al. | 381/183 |
| 4,979,586 | 12/1990 | Lazzeroni et al. | 381/183 |
| 4,993,065 | 2/1991 | Chiou | 381/183 |

*Primary Examiner*—Huyen Le

*Attorney, Agent, or Firm*—Birch, Stewart, Kolasch & Birch, LLP

[57] ABSTRACT

A fixing assembly for a helmet headset comprises a body piece, a microphone attached to the body piece, an earphone attached to the body piece, and cabling for taking signals to the earphone and from the microphone An elongated tongue piece is attached to the body piece, and the body piece includes at least two hole perforations with a width equal to that of the tongue piece.

16 Claims, 5 Drawing Sheets

FIXING ASSEMBLY FOR A HELMET HEADSET

FIELD OF THE INVENTION

The present invention relates to a fixing assembly for a helmet headset.

DESCRIPTION OF THE BACKGROUND ART

Modern fire brigade and rescue operations based on generally used technology rely heavily on an effectively functioning communication system. Furthermore, the availability of such a communication system is dependent on the individual links of the communication chain with the self-sustained smoke-diver working at the very end of the fire brigade's downline hierarchy representing one of its most important performers. As known, the smoke-diver's personal gear includes a special protective fire suit complemented with a compressed-air breathing apparatus and a protective helmet.

Effective and unrestrained use of the fireman's radio-telephone under working conditions is a prerequisite for him being able to carry out the correct operations with maximum speed and efficiency at the site of fire fighting and rescue. Smoke filling the space under fire prevents the fireman from seeing, and his hearing and tactile sense, his only available senses, can only perform if his ears are not capped or his hands tied to unnecessary actions. Yet, the fireman must have on-line voice communication access directly to the command system. This bidirectional voice communication must be designed for clear and undisturbed function, which presupposes that the earphone/microphone combination headset is positioned in the most optimal fashion with respect to the user's mouth and ear.

For this purpose, a combination headset has been developed that can be placed into the fire helmet. The headset includes both an earphone and a microphone. The microphone is attached to the smoke-diver's radio-telephone set by a connection cord via a control unit equipped with a separate push-to-talk button.

On-line communication by radiotelephone during, e.g., a smoke-diving operation presupposes that the radiotelephone is kept protected inside the fireman's fire suit or attached to the side of or between the air cylinders of the breathing apparatus. Then, an earphone/microphone headset must be mounted close to the user's head and connected to the radiotelephone set by a connection cord (or wirelessly).

Headsets for helmet-mounting have conventionally been tailored for each helmet model. Embodiments known in the art have been based on customized design, whereby the helmet manufacturer has ordered from a subcontractor a headset suited to impart an added value to the general-purpose helmet model.

Compatibility with different types of helmets has been attained by means of various adapter kits. However, these have been hampered by the skill and time required for dismantling the headset from one helmet and reassembly to another helmet.

German patent application DE 41 08 163 describes an embodiment in which the helmet-mountable headset is attached to the helmet by means of a Velcro tape. Such an arrangement invariably requires the helmet to be equipped with the Velcro tape counterpiece, which must be fixed in a particularly reliable manner. Repeated mounting and demounting may cause damage to the headset, and additionally, the Velcro tape itself may become worn or covered by dirt so that attachment of the headset cannot be relied on any more. In the embodiment according to the cited publication, the structure connecting the microphone to the earphone is made of resilient expanded polymer, which limits the use of the arrangement to helmets with a padded interior only.

SUMMARY OF THE INVENTION

It is an object of the present invention to overcome the drawbacks of the above-described prior-art techniques and to achieve an entirely novel type of fixing arrangement for a helmet headset.

The goal of the invention is accomplished by providing the perforated body piece of the headset assembly with a tongue piece which makes it possible to attach the headset to, e.g., the sweatband of the helmet.

More specifically, the fixing assembly according to the invention comprises a body piece having at least two hole perforations; a microphone attached to said body piece; an earphone attached to said body piece; cabling for taking signals to said earphone and from said microphone; and an elongated tongue piece for fixing the headset to a helmet, the tongue piece being attached to said body piece, the at least two hole perforations of the body piece having a width equal to or greater than the tongue piece whereby a portion of a helmet can be trapped between the elongated tongue piece and the body in order to fix the headset to a helmet.

The invention offers significant benefits.

The headset assembly according to the invention can be readily attached to the interior of any helmet irrespective of its interior outfit provided that the helmet interior includes a sweatband or similar band-like element. The fixing method of the headset is thus suited for use with any helmet model. The fixing arrangement is durable and suited for instant mounting and demounting.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following the invention is examined in greater detail with reference to the exemplifying embodiments illustrated in the appended diagrams in which.

DETAILED DESCRIPTION OF THE PREFERRED EMBODIMENT

In the context of the present invention, the term helmet headset refers to a helmet-mountable headset including a microphone and at least one earphone with facilities for communication with a system external to the helmet.

Figure 1:
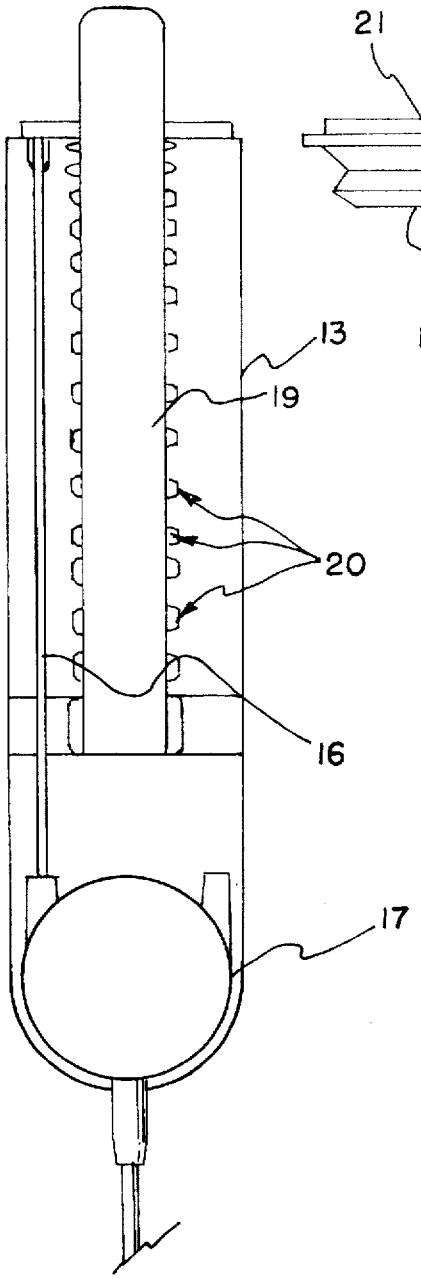
FIG. 1 shows a helmet headset according to the invention as seen from the direction of its earphone.

Referring to FIG. 1, a helmet headset according to the invention comprises an earphone 17, a microphone 14 and a cord 16 connecting these two. These structural elements are attached to a body piece 13 made of a stiff, undeformable material. The earphone 17 is of a type capable of delivering sufficient acoustic output under all noise conditions. The cap of the earphone 17 also acts as a connection box to which are attached both a microphone cord 16 and a connection cord 11 equipped with a quick-connect plug 12 at its end. The connection cord 11 is fabricated and dimensioned so that the cord gives the user full freedom to move his head without imposing stress on the attachment points of the connection cable.

Attached to the body piece 13 and in the immediate vicinity of the earphone 17, a tongue piece 19 is fixed which is slightly longer than the height of the body piece 13 and is narrower than the body piece. The body piece 13 is equipped with perforated holes 20 into which the tongue piece 19 can be threaded for fixing the headset into a helmet (not shown), or alternatively, to the mounting frame of a gas mask, for example. Obviously, the holes 20 must have a width not smaller than that of the tongue piece 19. The electrical connection of the headset to the external system is provided by the coiled cord 11 and the plug 12. The microphone is advantageously a vibration transducer 14, which is responsive to the acoustic vibrations generated by the speaker's vocal chords and propagated via the bones of his skull. The microphone 14 is appropriately equipped with a bellows shaped rubber piece 21, which is shaped so as to prevent the propagation of external noise via the rigid elements of the helmet to the recorded speech signal. Furthermore, the resilient rubber piece 21 acts as a protective cover of the microphone 14, whereby the rubber piece 21 is simultaneously smoothly pressed against the top of the user's head so as to conform evenly to the top of the head by virtue of the proper shape of the body piece 13 and the resiliently imposed compressive force.

Typically, the perforated holes 20 of the body piece 13 comprise slots 20 spaced at, e.g., 3–10 mm from each other. The width of the slots 20 must not be smaller than the width of the tongue piece 19. These slots 20 are therefore equal to or greater than the width of tongue piece 19. The body piece 13 is bent approximately conformant to the contour of the human skull, whereby a rounded L-shaped piece results. Typically, the length of the body piece 13 is equal to the distance from the ear to the top of the average human skull, which develops into approx. 25 cm.

Figure 2:
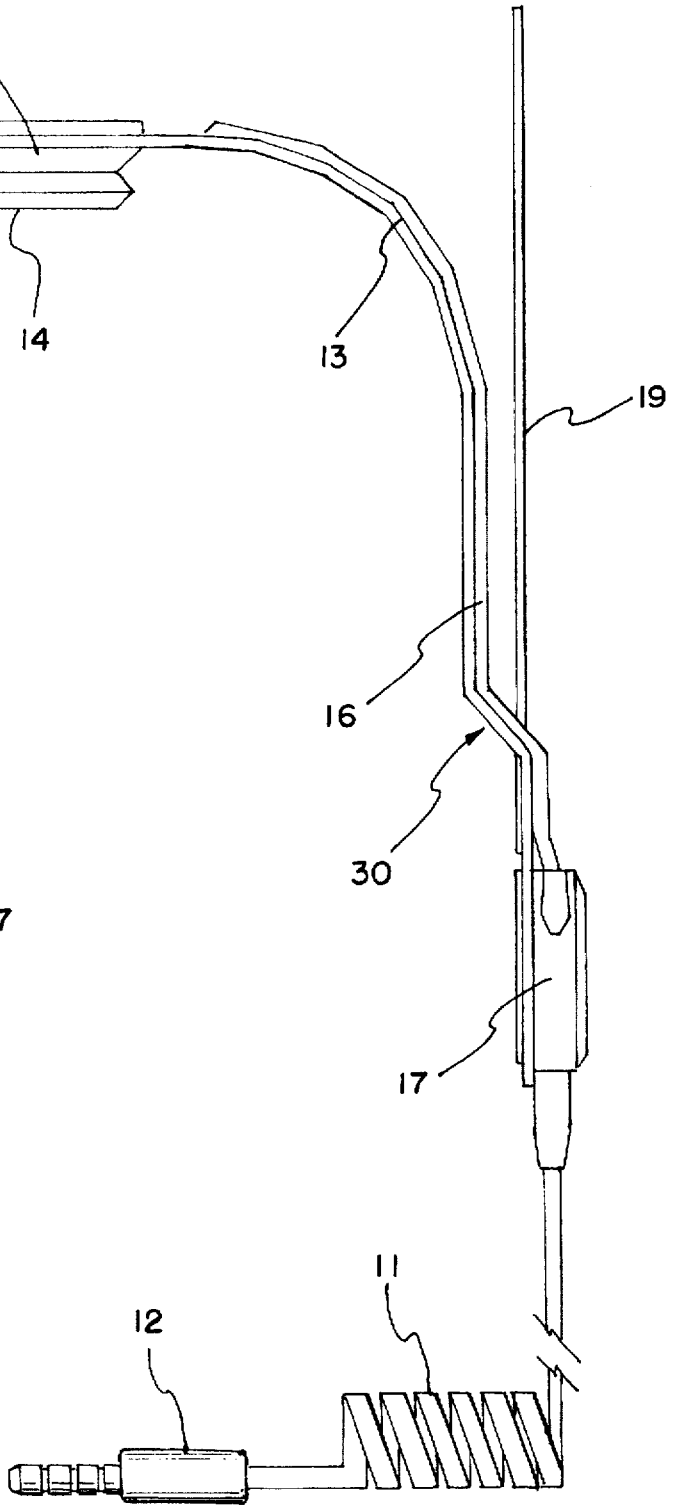
FIG. 2 shows the helmet headset of FIG. 1 as seen from the direction of the user's face (or neck)

As shown in FIG. 2, the lower part of the body piece 13 carries an angle part 30 suitable for forming a space to clamp the sweatband of the helmet between the tongue piece 19 and the body piece 13. The tongue piece 19 is fixed to the inside of the lower part of the body piece 13, under the angle part 30, in the immediate vicinity of the earphone 17.

According to the invention, the body piece 13 is made so stiff as to carry its own weight without deforming. Despite its stiffness, the body piece has a design of sufficient elasticity to permit its easy threading in place into the helmet.

Figure 3:
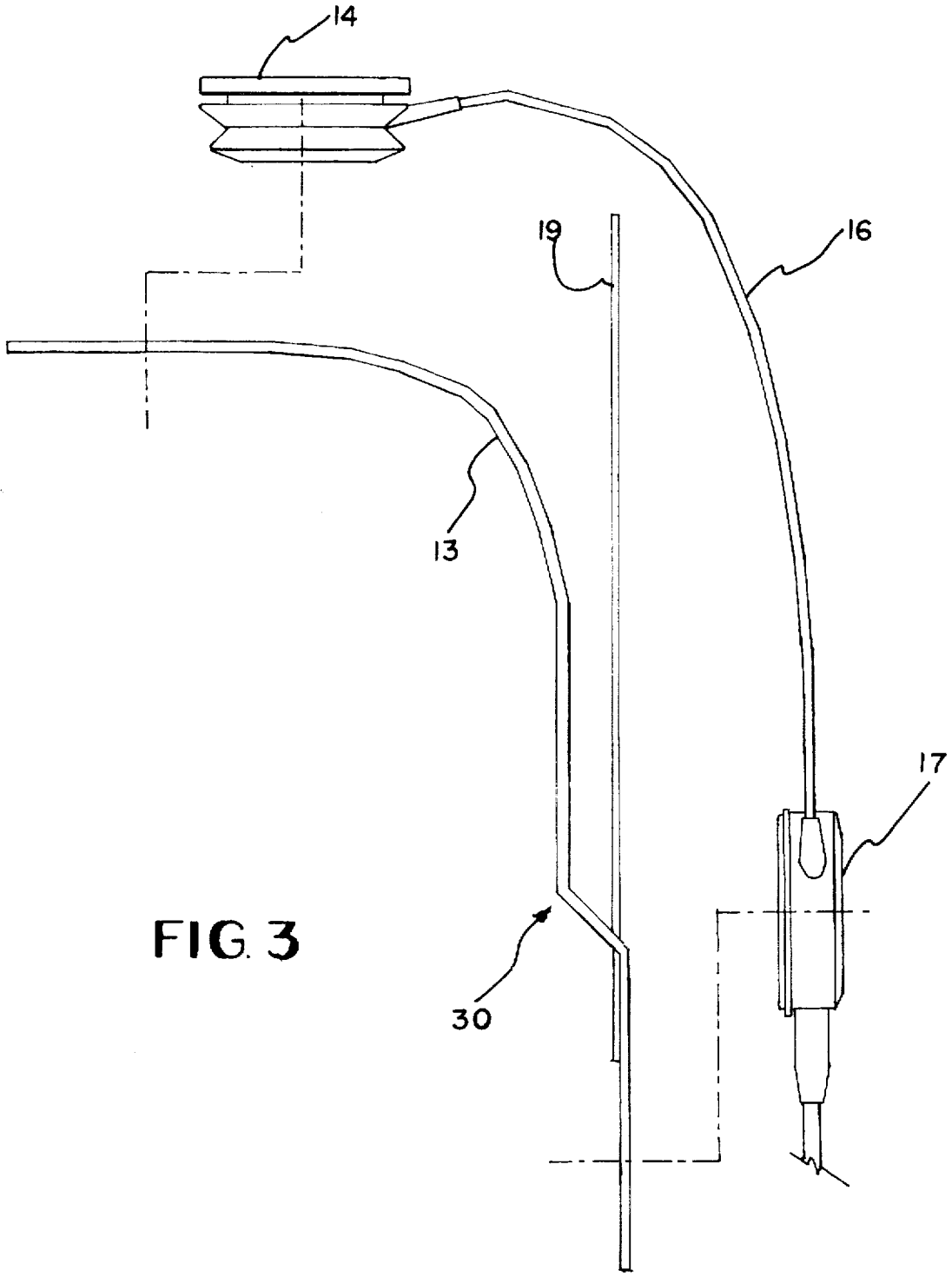
FIG. 3 shows the helmet headset of FIGS. 1 and 2 disassembled into its structural elements.

In FIG. 3 the body piece 13 and the earphone 17 as well as the microphone 14 plus the connecting cord thereof are shown detached from each other.

Figure 4:
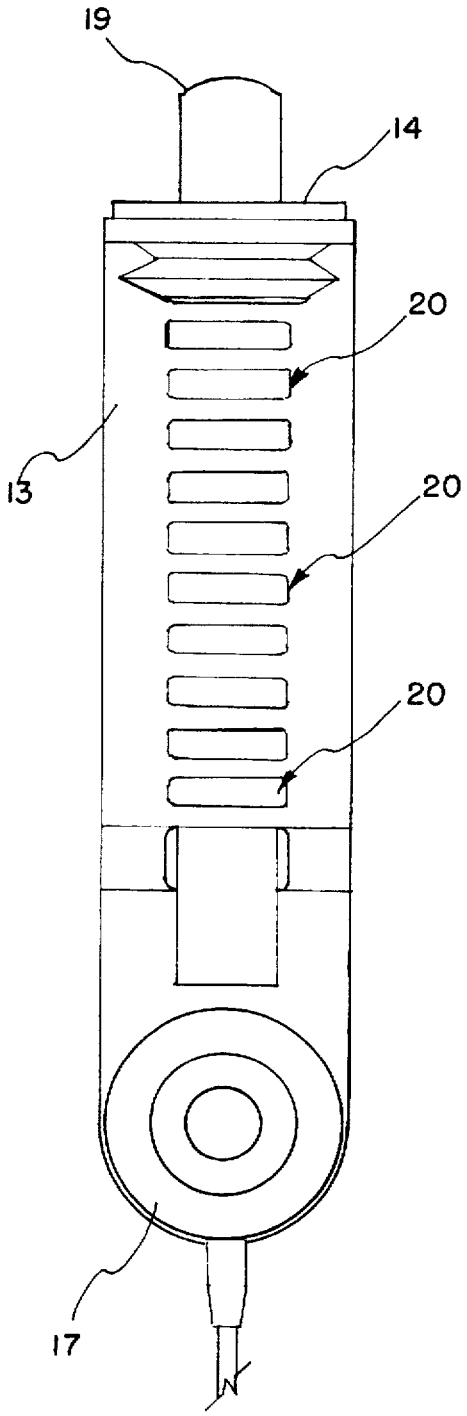
FIG. 4 shows the helmet headset of FIG. 1 as seen from the direction of the microphone.

In FIG. 4 the helmet headset is shown in an opposite direction to that of FIG. 1.

Figure 5:
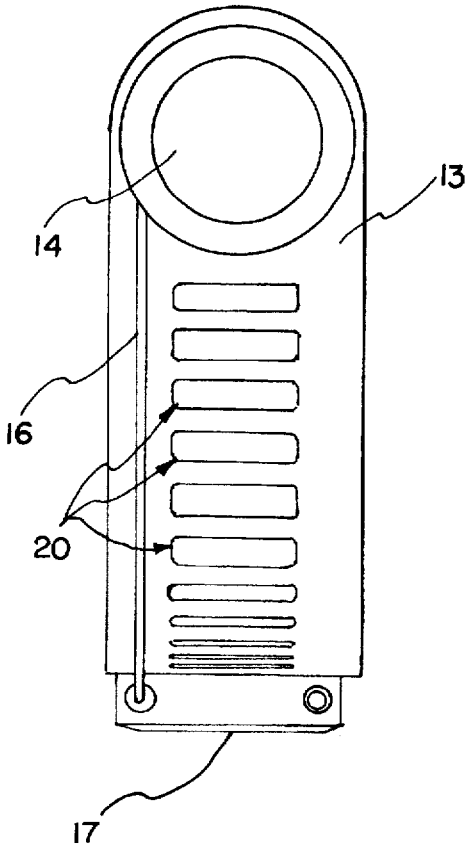
FIG. 5 shows the helmet headset of FIG. 1 as seen from above.

In FIG. 5, respectively, the helmet headset is shown viewed from above.

Figure 6:
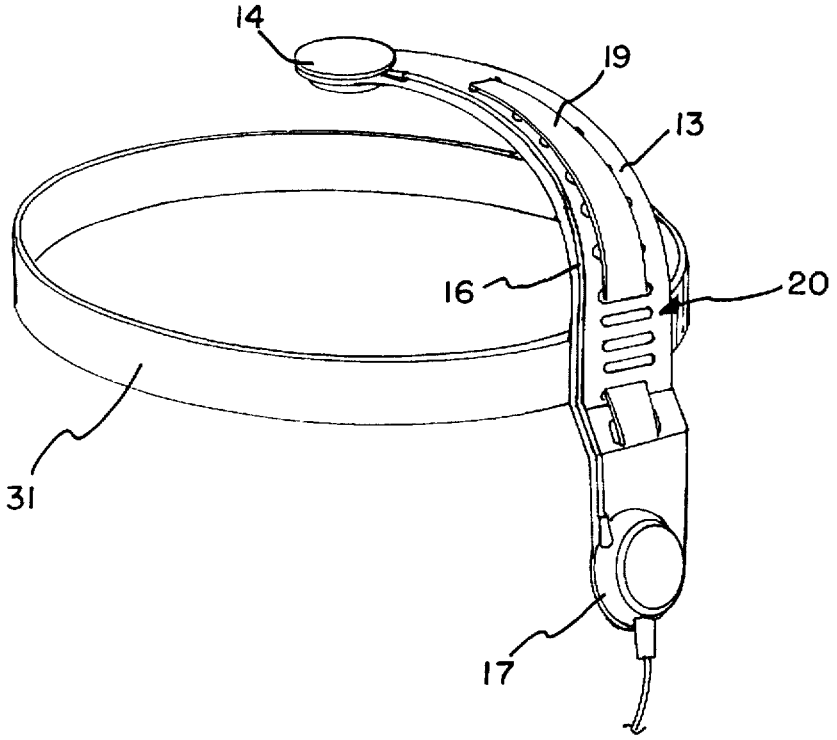
FIG. 6 shows the helmet headset of FIG. 1 attached to the sweatband of the helmet by a first method according to the invention.

In FIG. 6 the helmet headset according to the invention is shown fixed to the sweatband 31 of the helmet so that the sweatband remains clamped between the inside surface of the body piece 13 and the tongue piece 19. The end tail of the tongue piece 19 is threaded into slots 20 which are provided close to the microphone 14.

Figure 7:
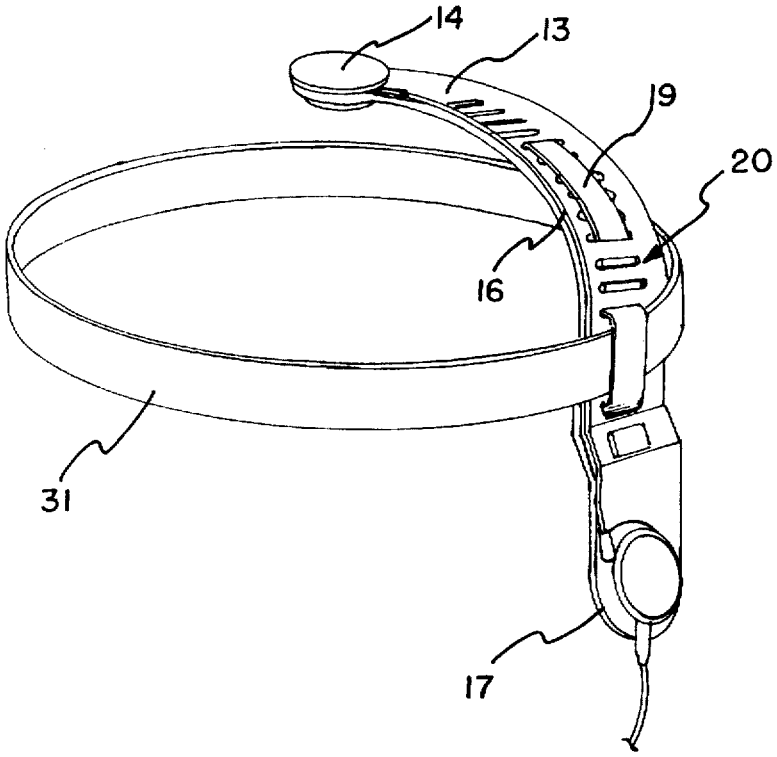
FIG. 7 shows the helmet headset of FIG. 1 attached to the sweatband of the helmet by a second method according to the invention.

In FIG. 7 the sweatband 31 is shown clamped between the tongue piece 19 and the outside surface of the body piece 13.

As illustrated in FIGS. 6 and 7, the helmet headset according to the invention can be fixed to any band-like element such as the tightening strap of a gas mask.

Figure 8:
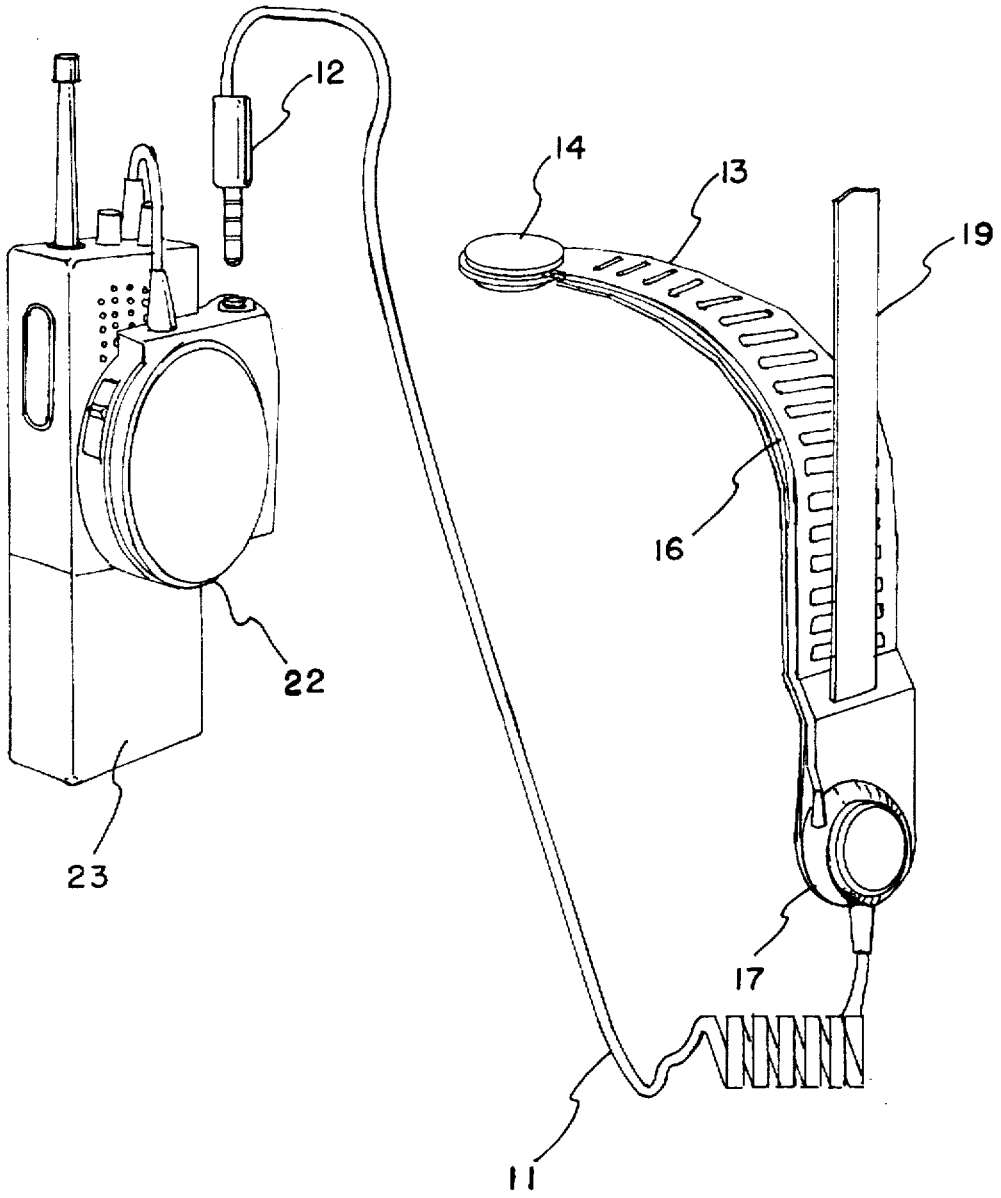
FIG. 8 shows a perspective view of a helmet headset according to the invention connected to a control unit and a radiotelephone.

FIG. 8 shows the connection of the helmet headset to a control unit 22 and therefrom further to a radiotelephone 23.

In principle, the tongue piece 19 may also be attached to the body piece 13 at its other end carrying the micro>phone 14. Thus, this tongue piece 19 acts as means for fixing the headset to a helmet.

The number of the slots 20 must be at least 2 in order to assure positive clamping of the sweatband 31 under the tongue piece 19. However, in order to facilitate flexible adjustability and mountability to different types of helmets, the number of the slots 20 is made greater, from 10 to 20, most appropriately approx. 15.

While the body piece 13 is typically made of a polymer material, also metallic and composite materials can be used according to the invention. The selection of materials for the tongue piece 19 can be the same as that used for the body piece 13.

Instead of slots 20, also a Velcro tape could be contemplated for the fixing of the end tail of the tongue piece 19.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A fixing assembly for a helmet headset comprising:

a body piece having at least two hole perforations;

a microphone attached to said body piece;

an earphone attached to said body piece;

cabling for taking signals to said earphone and from said microphone; and an elongated tongue piece for fixing the headset to a helmet, the tongue piece being attached to said body piece, the at least two hole perforations of the body piece having a width equal to or greater than the tongue piece whereby a portion of the helmet can be trapped between the elongated tongue piece and the body piece in order to fix the headset to the helmet.

2. The fixing assembly for a helmet headset as defined in claim 1, wherein said body piece has a structure sufficiently stiff to carry its own weight without any essential deformation.

3. The fixing assembly for a helmet headset as defined in claim 1, wherein essentially an entire length of said body piece is provided with the hole perforations.

4. The fixing assembly for a helmet headset as defined in claim 1, wherein the tongue piece is attached to said body piece in an immediate vicinity of said earphone.

5. The fixing assembly for a helmet headset as defined in claim 1, wherein the body piece has a curved configuration with the microphone being positioned over a head of a user and the earpiece being positioned adjacent an ear of the user when the headset is fixed in a helmet worn by a user.

6. A fixing assembly for a helmet headset comprising:

a body piece having at least two hole perforations;

a microphone attached to said body piece;

an earphone attached to said body piece;

cabling for taking signals to said earphone and from said microphone; and means for fixing the headset to a helmet, the means for fixing including an elongated tongue piece which is attached to said body piece, the at least two hole perforations of the body piece having a width equal to or greater than the tongue pieces in order to insert the elongated tongue piece into the perforations.

7. The fixing assembly for a helmet headset as defined in claim 6, wherein said body piece has a structure sufficiently stiff to carry its own weight without any essential deformation.

8. The fixing assembly for a helmet headset as defined in claim 6, wherein essentially an entire length of said body piece is provided with the hole perforations.

9. The fixing assembly for a helmet headset as defined in claim 6, wherein the tongue piece is attached to said body piece in an immediate vicinity of said earphone.

10. The fixing assembly for a helmet headset as defined in claim 6, wherein the body piece has a curved configuration with the microphone being positioned over a head of a user and the earpiece being positioned adjacent an ear of the user when the headset is fixed in a helmet worn by a user.

11. A method for fixing a helmet headset to a helmet, the method comprising the steps of:

providing a body piece, a microphone and an earphone for the headset, the microphone and earphone being connected to the body piece;

providing cabling for taking signals to said earphone and from said microphone; and detachably mounting the body piece of the headset to a headband of the helmet, wherein at least one hole is provided in the headset body piece and wherein an elongated tongue piece is attached to the body piece, the step of detachably mounting further comprises the step of inserting the tongue piece into the at least one hole in order to trap the headband of the helmet between the tongue piece and the body piece.

12. The method as defined in claim 11, wherein at least two holes are provided in the headset body piece, the step of detachably mounting further comprises the steps of:

threading the tongue piece into the at least two holes; and trapping the headband of the helmet between the tongue piece and the body piece during the step of threading to thereby detachably mount the headset to the helmet.

13. The method as defined in claim 11, further comprising the step of providing the body piece with a structure sufficiently stiff to carry its own weight without essential deformation.

14. The method as defined in claim 11, further comprising the step of providing essentially an entire length of the body piece with holes.

15. The method as defined in claim 11, further comprising the step of attaching the tongue piece to the body piece in an immediate vicinity of the earphone.

16. The method as defined in claim 11, further comprising the steps when the headset is mounted in the helmet and worn by a user of:

positioning the microphone over a head of a user; and positioning the earphone adjacent an ear of a user.

* * * * *